US006543705B1

(12) United States Patent
Liao

(10) Patent No.: US 6,543,705 B1
(45) Date of Patent: Apr. 8, 2003

(54) MOLD SPRAY GUN STRUCTURE

(76) Inventor: Chena Liao, No. 6, Lane 139, Dungtsuen Rd., Taiping City, Taichung Hsien (TW)

( * ) Notice: Subject to any disclaimer, the term of this patent is extended or adjusted under 35 U.S.C. 154(b) by 0 days.

(21) Appl. No.: 09/993,555

(22) Filed: Nov. 27, 2001

(51) Int. Cl.[7] ..... A62C 13/62

(52) U.S. Cl. ..... 239/340; 239/375; 239/525; 239/418

(58) Field of Search ..... 239/289, 340, 239/346, 349, 375, 409, 418, 433, 525

(56) References Cited

U.S. PATENT DOCUMENTS

| | | | | | |
|---|---|---|---|---|---|
| 197,057 | A | * | 11/1877 | Rundquist et al. | 239/375 |
| 1,104,217 | A | * | 7/1914 | Paasche | 239/375 |
| 1,429,537 | A | * | 9/1922 | Rothermund | 239/375 |
| 1,532,789 | A | * | 4/1925 | Vollrath | 239/375 |
| 1,927,743 | A | * | 9/1933 | Ivey | 239/375 |
| 2,389,864 | A | * | 11/1945 | Miller | 239/375 |
| 2,550,404 | A | * | 4/1951 | Chasan et al. | 239/375 |
| 2,820,578 | A | * | 1/1958 | Dickman | 239/375 |
| 3,107,058 | A | * | 10/1963 | Corbett | 239/375 |
| 3,716,195 | A | * | 2/1973 | Silva | 222/174 |
| 4,079,893 | A | * | 3/1978 | Bass | 239/346 |
| 5,667,731 | A | * | 9/1997 | Junkel et al. | 239/289 |
| 6,341,736 | B1 | * | 1/2002 | Liao | 239/306 |

* cited by examiner

*Primary Examiner*—Michael Mar
*Assistant Examiner*—Christopher Kim
(74) *Attorney, Agent, or Firm*—Rosenberg, Klein & Lee

(57) ABSTRACT

A mold spray gun structure includes a gun body, a spray head, and a paint can. The gun body is provided with a connection portion for mounting the spray head. The connection portion is formed with a locking recess which has an inner wall formed with at least one plane portion and has an opening which has two sides formed with two opposite hook portions. The spray head is formed with a neck portion locked in the locking recess. The neck portion is formed with at least one plane portion which is rested on the plane portion of the locking recess, and the hook portions are hooked and locked on the neck portion of the spray head.

5 Claims, 4 Drawing Sheets

MOLD SPRAY GUN STRUCTURE

BACKGROUND OF THE INVENTION

1. Field of the Invention

The present invention relates to a mold spray gun structure, and more particularly to a mold spray gun structure, wherein the spray head may be mounted on the gun body easily and rapidly in a snap locking manner.

2. Description of the Related Art

A conventional mold spray gun in accordance with the prior art comprises a gun body, a spray head mounted on the gun body, and a paint can mounted on the spray head. The spray head has a first end formed with a spray hole, and a second end formed with a neck portion mounted on the gun body. A fastening ring is mounted on the gun body, for fastening the neck portion of the spray head mounted on the gun body. The spray hole of the spray head is easily blocked, so that it is necessary to detach the spray head from the gun body to clean the spray hole of the spray head. Thus, the user often has to loosen the fastening ring to detach the spray head from the gun body and to tighten the fastening ring to secure the spray head on the gun body, thereby causing inconvenience to the user.

SUMMARY OF THE INVENTION

The present invention has arisen to mitigate and/or obviate the disadvantage of the conventional mold spray gun.

The primary objective of the present invention is to provide a mold spray gun structure, wherein the neck portion of the spray head may be mounted on the connection portion of the gun body easily and rapidly in a snap locking manner.

Another objective of the present invention is to provide a mold spray gun structure, wherein the plane portions of the neck portion of the spray head are rested on the plane portions of the locking recess of the connection portion of the gun body, so that the neck portion of the spray head cannot be rotated relative to the connection portion of the gun body, such that the neck portion of the spray head may be positioned on the connection portion of the gun body rigidly and stably.

A further objective of the present invention is to provide a mold spray gun structure, wherein the neck portion of the spray head is positioned on the connection portion of the gun body rigidly and stably, so that the paint can mounted on the neck portion of the spray head may have an exact and rigid positioning effect, and will not interfere with operation of the gun body, thereby preventing from affecting the painting work.

In accordance with the present invention, there is provided a mold spray gun structure, comprising: a gun body, a spray head mounted on the gun body, and a paint can mounted on the spray head, the gun body provided with a connection portion for mounting the spray head, wherein:

the connection portion of the gun body is formed with a locking recess, the locking recess has an inner wall formed with at least one plane portion, the locking recess has an opening, the opening has two sides formed with two opposite hook portions, the spray head has one end formed with a neck portion locked in the locking recess of the connection portion of the gun body, the neck portion of the spray head has a surface formed with at least one plane portion, the at least one plane portion of the neck portion of the spray head is rested on the at least one plane portion of the locking recess of the connection portion of the gun body, and the hook portions are hooked and locked on the neck portion of the spray head.

Preferably, the inner wall of the locking recess is formed with a plurality of plane portions which are connected to form a curve shape.

Preferably, the inner wall of the locking recess is formed with two opposite plane portions, and an arcuate portion located between the two opposite plane portions.

Preferably, the neck portion of the spray head is formed with a plurality of plane portions which are connected to form a polygonal shape.

Preferably, the neck portion of the spray head is formed with two opposite plane portions, and an arcuate portion located between the two opposite plane portions.

Further benefits and advantages of the present invention will become apparent after a careful reading of the detailed description with appropriate reference to the accompanying drawings.

DETAILED DESCRIPTION OF THE INVENTION

Figure 1:
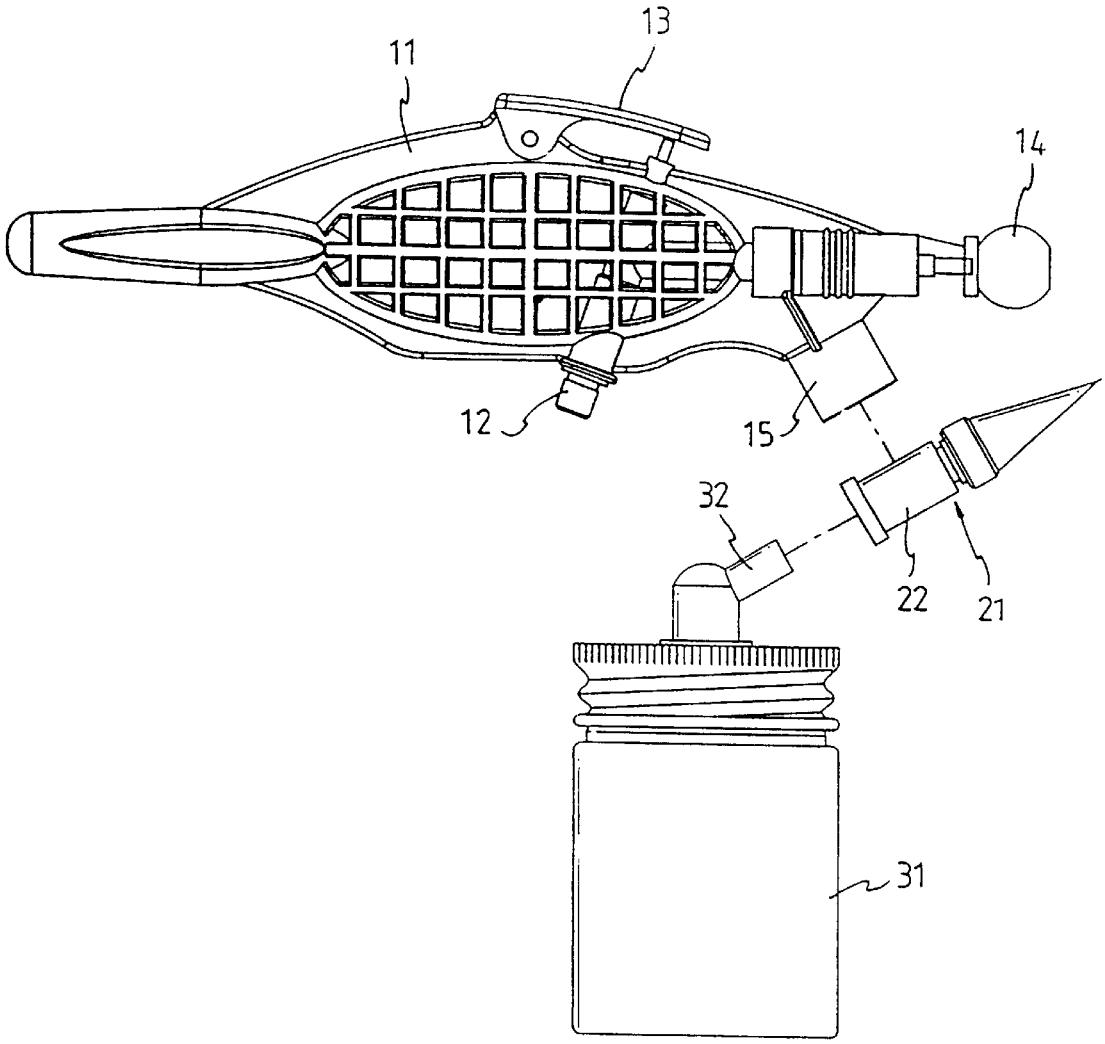
FIG. 1 is a plan exploded view of a mold spray gun structure in accordance with the present invention.
Figure 2:
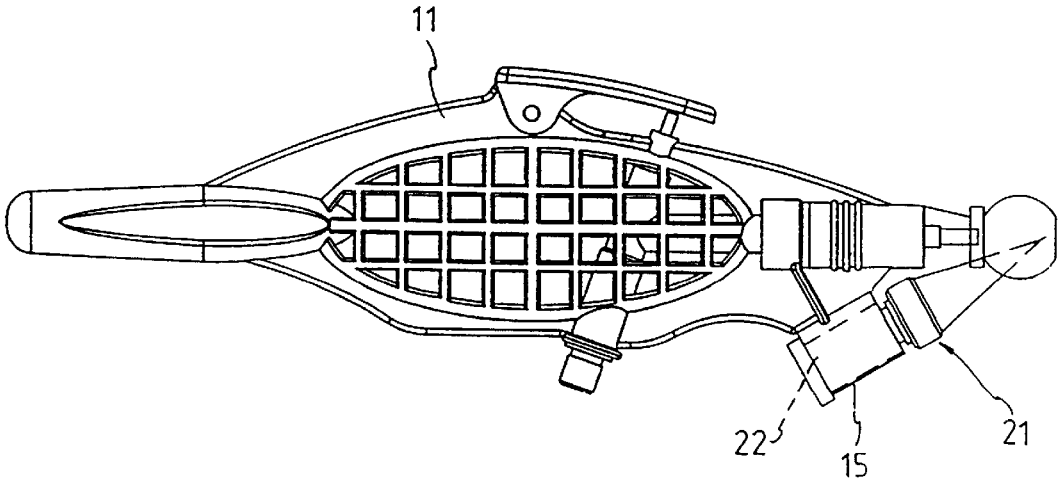
FIG. 2 is an assembly view of the mold spray gun structure as shown in FIG. 1.

Referring to the drawings and initially to FIGS. 1 and 2, a mold spray gun structure in accordance with a preferred embodiment of the present invention comprises a gun body 11, a spray head 21, and a paint can 31.

The gun body 11 is provided with an air valve 12, so that ambient air of a high pressure may enter the gun body 11 through the air valve 12. The gun body 11 is provided with an air valve switch 13 for controlling flow of the air of a high pressure contained in the gun body 11. The gun body 11 has one end provided with a nozzle 14 for ejecting the air of a high pressure contained in the gun body 11. The gun body 11 is provided with a connection portion 15 for mounting the spray head 21.

The spray head 21 has a first end formed with a cone-shaped portion which has a tip formed with a spray hole (not shown), and a second end formed with a neck portion 22 mounted on the connection portion 15 of the gun body 11. The spray hole of the cone-shaped portion of the spray head 21 is located adjacent to the nozzle 14 of the gun body 11 as shown in FIG. 2.

The paint can 31 has a top portion formed with a connection mouth 32 for mounting the neck portion 22 of the spray head 21.

Figure 3:
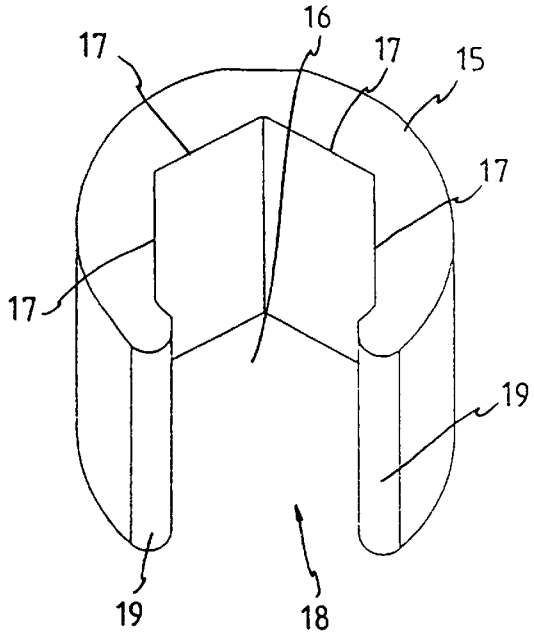
FIG. 3 is a perspective view of a connection portion of a gun body of the mold spray gun structure in accordance with an embodiment of the present invention.
Figure 4:
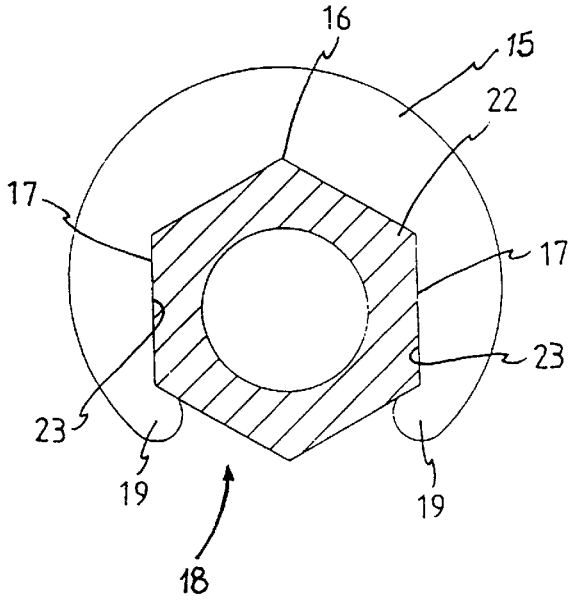
FIG. 4 is a cross-sectional view of the mold spray gun structure as shown in FIG. 2.

Referring to FIGS. 1–3, the connection portion 15 of the gun body 11 is formed with a locking recess 16. The locking recess 16 has an inner wall formed with a plurality of plane portions 17 which are connected to form a curve shape. The locking recess 16 has one end provided with an opening 18. The opening 18 has two sides formed with two opposite hook portions 19.

Referring to FIGS. 1–4, the neck portion 22 of the spray head 21 has a surface formed with a plurality of plane portions 23 which are connected to form a polygonal (preferably hexagonal) shape. When the neck portion 22 of the spray head 21 is mounted on the connection portion 15 of the gun body 11, the neck portion 22 of the spray head 21 is locked in the locking recess 16 of the connection portion 15 of the gun body 11. Thus, the plane portions 23 of the neck portion 22 of the spray head 21 are rested on the plane portions 17 of the locking recess 16 of the connection portion 15 of the gun body 11, and the hook portions 19 are hooked and locked on the neck portion 22 of the spray head 21.

Accordingly, the neck portion 22 of the spray head 21 may be mounted on the connection portion 15 of the gun body 11 easily and rapidly in a snap locking manner. In addition, the plane portions 23 of the neck portion 22 of the spray head 21 are rested on the plane portions 17 of the locking recess 16 of the connection portion 15 of the gun body 11, so that the neck portion 22 of the spray head 21 cannot be rotated relative to the connection portion 15 of the gun body 11, such that the neck portion 22 of the spray head 21 may be positioned on the connection portion 15 of the gun body 11 rigidly and stably. Further, the neck portion 22 of the spray head 21 is positioned on the connection portion 15 of the gun body 11 rigidly and stably, so that the paint can 31 mounted on the neck portion 22 of the spray head 21 may have an exact positioning effect, and will not interfere with operation of the gun body 11, thereby preventing from affecting the painting work.

Figure 5:
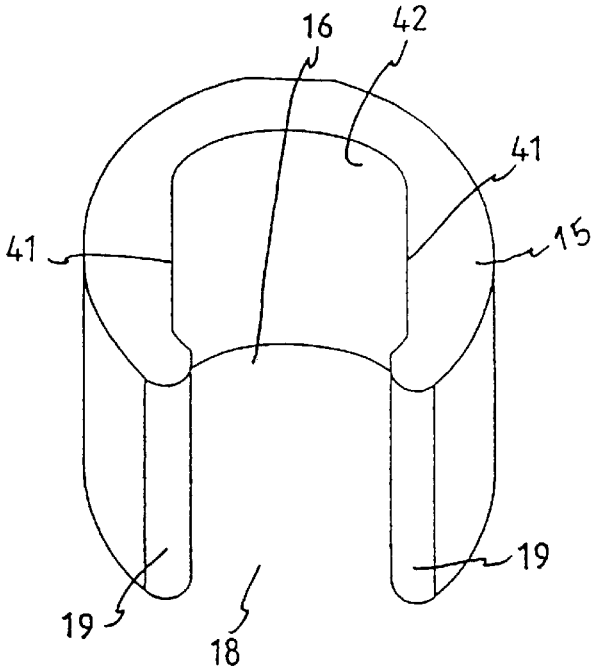
FIG. 5 is a perspective view of a connection portion of a gun body of the mold spray gun structure in accordance with another embodiment of the present invention.

Referring to FIGS. 2 and 5, the connection portion 15 of the gun body 11 is formed with a locking recess 16. The locking recess 16 has an inner wall formed with two opposite plane portions 41, and an arcuate portion 42 located between the two opposite plane portions 41. The locking recess 16 has one end provided with an opening 18. The opening 18 has two sides formed with two opposite hook portions 19.

Figure 6:
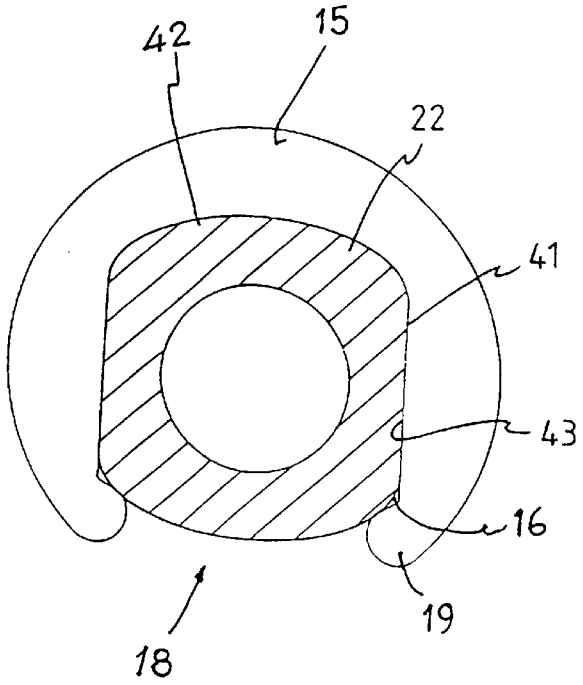
FIG. 6 is a cross-sectional view of the mold spray gun structure as shown in FIG. 2, in accordance with another embodiment of the present invention.

Referring to FIGS. 2 and 6, the neck portion 22 of the spray head 21 has a surface formed with two opposite plane portions 43 and an arcuate portion (not labeled) located between the two opposite plane portions 43. When the neck portion 22 of the spray head 21 is mounted on the connection portion 15 of the gun body 11, the neck portion 22 of the spray head 21 is locked in the locking recess 16 of the connection portion 15 of the gun body 11. Thus, the plane portions 43 of the neck portion 22 of the spray head 21 are rested on the plane portions 41 of the locking recess 16 of the connection portion 15 of the gun body 11, and the hook portions 19 are hooked and locked on the neck portion 22 of the spray head 21.

Accordingly, the neck portion 22 of the spray head 21 may be mounted on the connection portion 15 of the gun body 11 easily and rapidly in a snap locking manner. In addition, the plane portions 43 of the neck portion 22 of the spray head 21 are rested on the plane portions 41 of the locking recess 16 of the connection portion 15 of the gun body 11, so that the neck portion 22 of the spray head 21 cannot be rotated relative to the connection portion 15 of the gun body 11, such that the neck portion 22 of the spray head 21 may be positioned on the connection portion 15 of the gun body 11 rigidly and stably. Further, the neck portion 22 of the spray head 21 is positioned on the connection portion 15 of the gun body 11 rigidly and stably, so that the paint can 31 mounted on the neck portion 22 of the spray head 21 may have an exact positioning effect, and will not interfere with operation of the gun body 11, thereby preventing from affecting the painting work.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A mold spray gun structure, comprising: a gun body, a spray head mounted on the gun body, and a paint can mounted on the spray head, the gun body being provided with a connection portion for mounting the spray head, wherein:

the connection portion of the gun body is integrally formed on the gun body in one-piece formation and is formed with a locking recess, the locking recess has an inner wall formed with at least one plane portion, the locking recess has an opening, the opening has two sides formed with two opposite hook portions extending inwardly toward each other, the spray head has one end formed with a neck portion locked in the locking recess of the connection portion of the gun body, the neck portion of the spray head has a surface formed with at least one plane portion, the at least one plane portion of the neck portion of the spray head is rested on the at least one plane portion of the locking recess of the connection portion of the gun body, and the hook portions are hooked and locked on the neck portion of the spray head.

2. The mold spray gun structure in accordance with claim 1, wherein the at least one plane portion of the inner wall of the locking recess includes a plurality of plane portions which are connected to form an arcuate shape.

3. The mold spray gun structure in accordance with claim 1, wherein the at least one plane portion of the inner wall of the locking recess includes two opposite plane portions, and an arcuate portion integrally formed and located between the two opposite plane portions.

4. The mold spray gun structure in accordance with claim 1, wherein the at least one plane portion of the neck portion of the spray head includes a plurality of plane portions which are connected to form a polygonal shape.

5. The mold spray gun structure in accordance with claim 1, wherein the at least one plane portion of the neck portion of the spray head includes two opposite plane portions, and an arcuate portion integrally formed and located between the two opposite plane portions.

* * * * *